US011204222B1

(12) United States Patent
Boucher

(10) Patent No.: US 11,204,222 B1
(45) Date of Patent: Dec. 21, 2021

(54) MOBILE SHIELD FOR PROTECTION FROM PROJECTILES AND RADIATION

(71) Applicant: Dartmouth-Hitchcock Clinic, Lebanon, NH (US)

(72) Inventor: Neal M. Boucher, Newport, NH (US)

(73) Assignee: Dartmouth-Hitchcock Clinic, Lebanon, NH (US)

( * ) Notice: Subject to any disclaimer, the term of this patent is extended or adjusted under 35 U.S.C. 154(b) by 0 days.

(21) Appl. No.: 16/708,274

(22) Filed: Dec. 9, 2019

Related U.S. Application Data

(60) Provisional application No. 62/777,015, filed on Dec. 7, 2018.

(51) Int. Cl.
*F41H 5/18* (2006.01)

(52) U.S. Cl.
CPC ..... *F41H 5/18* (2013.01)

(58) Field of Classification Search
CPC ..... F41H 5/00; F41H 5/02; F41H 5/06; F41H 5/18
USPC ..... 89/36.09, 36.02, 36.01, 36.05, 36.07
See application file for complete search history.

(56) References Cited

U.S. PATENT DOCUMENTS

| | | | | |
|---|---|---|---|---|
| 4,573,396 | A * | 3/1986 | Streetman | F41H 7/04 109/1 S |
| 4,781,101 | A * | 11/1988 | Zevuluni | F41H 5/14 109/49.5 |
| 6,845,701 | B2 * | 1/2005 | Drackett | F41H 5/14 89/36.09 |
| 7,891,283 | B2 * | 2/2011 | Kleniatis | F41H 5/08 89/36.09 |
| 8,015,910 | B1 * | 9/2011 | Fuqua | F41H 5/14 89/36.09 |
| 8,549,979 | B2 * | 10/2013 | Spransy | F41H 5/24 89/36.09 |
| 9,347,748 | B1 * | 5/2016 | Crisp | F41H 5/08 |
| 9,448,041 | B2 * | 9/2016 | Gonda | F41H 5/14 |
| 2019/0383346 | A1 * | 12/2019 | Clayton | F41H 1/02 |
| 2020/0256647 | A1 * | 8/2020 | Howell | F41H 5/0407 |

* cited by examiner

*Primary Examiner* — John Cooper
(74) *Attorney, Agent, or Firm* — Loginov & Associates, PLLC; William A. Loginov

(57) ABSTRACT

A mobile radiation and ballistic shield can include a central shield with an outer layer of steel and a second layer of lead, and a chassis having front wheels and rear wheels. One or more auxiliary shields can be hinged outward from the central shield into a deployed position to increase ballistic coverage, and can be hinged inward to decrease the width of the mobile radiation and ballistic shield to pass through doorways and elevators.

11 Claims, 13 Drawing Sheets

MOBILE SHIELD FOR PROTECTION FROM PROJECTILES AND RADIATION

RELATED APPLICATION

This application claims the benefit of U.S. Provisional Application Ser. No. 62/777,015, filed Dec. 7, 2018, entitled MOBILE SHIELD FOR PROTECTION FROM PROJECTILES AND RADIATION, the entire disclosure of which is herein incorporated by reference.

FIELD OF THE INVENTION

This invention relates to protective equipment and more particularly to mobile equipment used to secure persons and/or radiological materials.

BACKGROUND OF THE INVENTION

High level radiation sources can be an important component of various systems housed at civilian sites away from secure military compounds, including medical facilities, educational institutions, industrial facilities, and others. Unfortunately, these high level radiation sources may be targeted by potential terrorists who seek access to a radiation source so that it can be used to inflict harm on military or civilian targets. These sites often employ individuals who are trained in the safe keeping and handling of these high level radiation sources, however, sites such as hospitals and universities do not typically have armed personnel in place to safeguard the radiation sources against attacks, thereby making them an easy target for a potential terrorist.

A potential terrorist who manages to obtain a high-level radiation source from a non-militarized site can then present a double threat while wielding both ballistic arms and high-level radiation. Any personnel attempting to prevent the theft and contain the radiation source could face the simultaneous threats of gunfire and deadly radiation. Radiation protective suits can be heavy and bulky, while providing no protection against small arms fire, and armor against small arms fire can be heavy and bulky while providing no protection against radiation.

SUMMARY OF THE INVENTION

A mobile radiation and ballistic shield can be a mobile device on wheels that can provide cover for personnel attempting to recover and contain a radiation source from an armed thief. More generally, this invention provides a protective device that can be used in the face of simultaneous radiation and ballistic threats, while also allowing freedom of motion to pursue an individual attempting to steal radioactive material. A wheeled shield can allow for one or more personnel to advance towards a stolen radiation source while also providing sufficient protection so that personnel can safely be free of bulky radiation suits that may limit an individual's ability to operate a firearm efficiently and accurately.

In an embodiment, a mobile radiation and ballistic shield can include a central shield with a first outer ballistic shielding layer and a second radiation shielding layer, a wheeled chassis, and at least one auxiliary shield hingedly attached to the central shield. At least one brace with a first state and a second state can selectively hold the at least one auxiliary shield in an outward deployed position in the first state, and the at least one brace can allow the at least one auxiliary shield to hinge inward to a collapsed position in the second state. The first outer ballistic shielding layer can be steel. The second radiation shielding layer can be lead. The central shield can include a third ballistic layer. The at least one brace can include a semi-rigid coil spring, wherein in the first state coils of the spring are in contact with the neighboring coils forming a tube, and in the second state the semi-rigid coil spring has been bent into a U-shape. The wheeled chassis further comprising front wheels and rear wheels. The front wheels can be on a fixed axle, and the rear wheels can be casters that can pivot. A center of gravity of the shield system can be located above an area between the front wheels and the rear wheels. The mobile radiation and ballistic shield can include a ricochet plate extending downward from the chassis toward the ground. The ricochet plate can be hingedly attached to the chassis. The ricochet plate can extend downward from the chassis to approximately one half inch above the ground. The central shield can be at an angle from vertical in a range of approximately 12 to 15 degrees. The wheelbase of the chassis can be approximately 12 inches, and a center of gravity of the shield system can be located above an area between the front wheels and the rear wheels. The second radiation shielding layer can include a frame of steel surrounding the edges of the layer of lead, wherein the front side ballistic shielding layer is bonded to the frame of steel, and the rear-side layer of steel is bonded to the frame of steel, thereby encapsulating the layer of lead.

A shield system can include a central shield that can include a front side ballistic shielding layer of steel, a rear side layer of steel, and a center radiation shielding layer. The center radiation shielding layer can include a layer of lead and a frame of steel, wherein the frame of steel can surround the edges of the layer of lead. The front side ballistic shielding layer can be bonded to the frame of steel, and the rear-side layer of steel can be bonded to the frame of steel, thereby encapsulating the layer of lead. The shield system can include an auxiliary shield and a hinge that hingedly connects the auxiliary shield to the central shield. The auxiliary shield can include an auxiliary front side ballistic shielding layer of steel, an auxiliary rear-side layer of steel, and an auxiliary center radiation shielding layer. The auxiliary center radiation shielding layer can include an auxiliary layer of lead and an auxiliary frame of steel surrounding the edges of the auxiliary layer of lead. The Auxiliary front side ballistic shielding layer can be bonded to the frame of steel, and the rear-side layer of steel can be bonded to the frame of steel, thereby encapsulating the layer of lead.

A method of staying safe from simultaneous ballistic and radiation threats can include walking behind a mobile shield, blocking incoming ballistic fired shots with the mobile shield, and blocking 60% of radiation that originates from in front of the mobile shield by using the mobile shield to block the radiation, wherein the ballistic fired shots and the radiation are blocked at the same time. The method can include extending one or more auxiliary shields out from the mobile shield, wherein the auxiliary shields are hingedly attached to the mobile shield.

BRIEF DESCRIPTION OF THE DRAWINGS

The invention description below refers to the accompanying drawings, of which.

DETAILED DESCRIPTION

Figure 1:
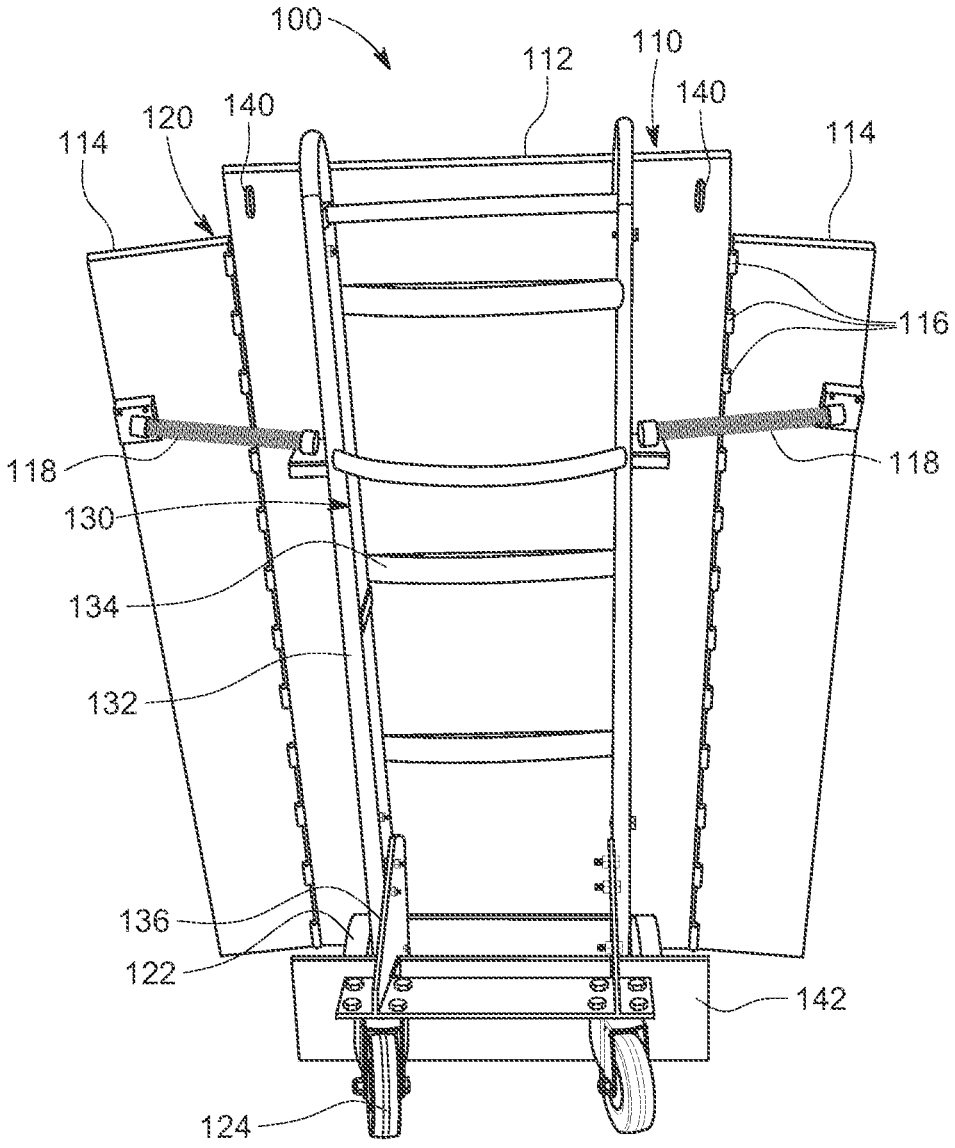
FIG. 1 is a rear view of a mobile radiation and ballistic shield in an extended state, according to an illustrative embodiment.

A mobile radiation and ballistic shield can include a mobile platform, shielding against small arms and other light weapons, and shielding against radiation. FIG. 1 is a rear view of a mobile radiation and ballistic shield in an extended state, according to an illustrative embodiment. A user can position the mobile shield between the user and a ballistic and/or radiative threat. A mobile radiation and ballistic shield 100 can have a protective shield system 110 that can be made from multiple layers of protective material. A protective shield system 110 can have a central shield 112, and can have one or more extendable auxiliary shields 114 that can be hingedly mounted to the mobile radiation and ballistic shield 100 by hinges 116. A hinge 116 can be a piano hinge (e.g. continuous hinge) that can be secured to the back of the central shield 112. The extendable auxiliary shields 114 can be held outwards in the extended position, as shown, by braces 118. A brace 118 can be can be a spring material that can bias the auxiliary shield 114 outwards into the extended state, and a brace 118 can flex to allow the auxiliary shields to fold inward. A brace 118 can be a semi-rigid coil spring. A semi-rigid coil spring can have coils that are each in contact with the neighboring coils, thereby forming a cylinder, or tube, with the spiraling coils forming a substantially unbroken exterior. With each coil abutting the next, the semi-rigid coil spring has remarkable strength against compression along the central axis of the spring, and this strength against compression can hold the extendable auxiliary shields outwards in the extended position. To fold the auxiliary shields into the collapsed position, the user can push or pull on the semi-rigid coil spring in a direction at an angle to the central axis of the coil spring, thereby bending the spring from a cylinder into a U-shape. With the semi-rigid coil spring bent into a U-shape, the extendable auxiliary shields can be easily folded inward to the collapsed position. When the semi-rigid coil spring is returned to the cylinder conformation it regains its axial strength and becomes capable of holding the auxiliary shield outward until the next time the axial strength is broken by bending the spring into the U-shape. In various embodiments a brace 118 can be a rigid material that can lock the auxiliary shield 114 in the extended state, and the brace 118 can be disconnected to allow the auxiliary shield 114 to fold inward. A user positioned behind the mobile shield can pull the auxiliary shields 114 back towards the user to reduce the width of the mobile shield 100, so that the mobile shield 100 can pass through doorways or other narrow areas. In various embodiments, the auxiliary shields 114 can be shorter than the central shield 112, and the mobile radiation and ballistic shield 100 can have a side notch 120 that can allow the user to peek out from behind the shield while remaining partially protected.

The mobile radiation and ballistic shield 100 can have front wheels 122 that can support the weight of the protective shield system 110, and can be protected behind the protective shield system 110. The mobile radiation and ballistic shield 100 can also have rear wheels 124 that can help to support the weight of the protective shield system 110 and can prevent the mobile radiation and ballistic shield 100 from tipping backwards towards the user. The front wheels can be larger than the rear wheels so that the front wheels can carry more than half of the weight of the protective shield system 100, and the larger front wheels can allow for ease of rolling over rugs, bumps, cracks, or other obstacles. Rear wheels 124 can be casters that can swivel to allow the mobile radiation and ballistic shield 100 to turn sharp corners and maneuver in tight environments. The rear wheels can be smaller than the front wheels so that they can more easily pivot or turn the mobile radiation and ballistic shield with greater agility than if the front wheels and rear wheels where the same size. The specific sizes of the front and wheels can be varied, and can be configured for the primary surface of use, with larger and less agile wheels in use for outdoor terrain, and smaller more agile wheels used for confined indoor spaces, and with front wheels that are relatively larger than the rear wheels. The front wheels 122 can be larger than the rear wheels 124. Increasing the size of the front wheels can help the mobile radiation and ballistic shield 100 to overcome obstacles, and reducing the size of the rear wheels can lower the center of gravity and can increase stability for the mobile radiation and ballistic shield. In various embodiments the front wheels 122 can be approximately 8 inches, and the rear wheels can be approximately 6 inches.

The mobile radiation and ballistic shield 100 can have a support frame 130. The support frame 130 can be configured to support a shield system that weighs approximately 1200 pounds. The support frame 130 can have one or more vertical bars 132, and one or more horizontal bars 134 that can allow a user to hold the mobile radiation and ballistic shield 100 in different positions and exert leverage in different directions to maneuver and advance the shield 100. The support frame 130 can also have a chassis 136 that can connect to the front wheels 122 and/or rear wheels 124. The mobile radiation and ballistic shield 100 can have one or more lift tabs 140 on the support frame 130 and/or the shield system 110 that can allow heavy equipment to be attached to the mobile radiation and ballistic shield 100 to lift and carry the shield 100.

Figure 2:
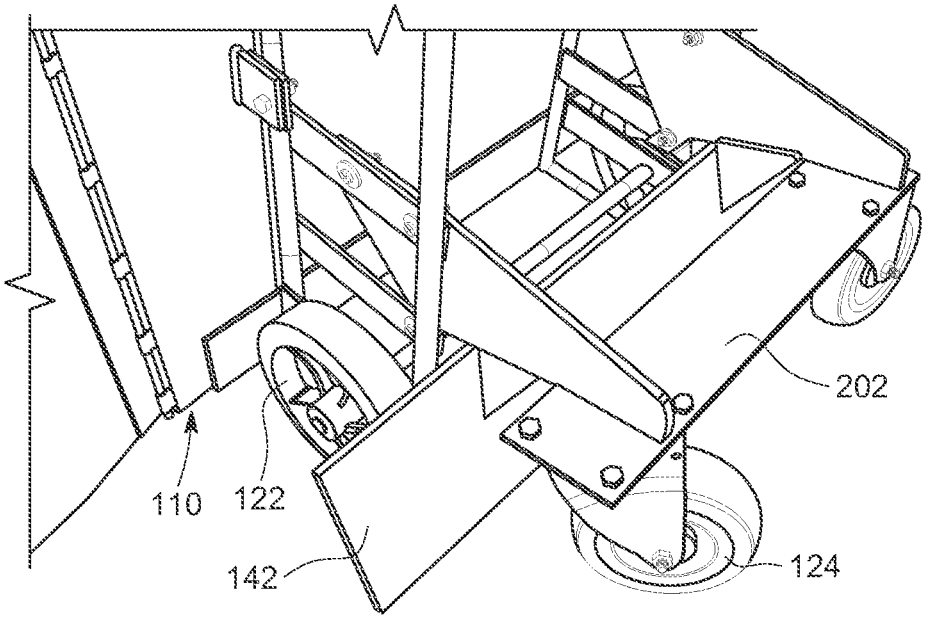
FIG. 2 is a perspective view of a chassis of a mobile radiation and ballistic shield with a ricochet plate, according to an illustrative embodiment.

A ricochet plate 142 can extend down from the support frame 136, and can stop rounds that are fired under the shield system 110. Ricochet plate 142 can extend down between the front wheels 122 and the rear wheels 124. The ricochet plate 142 can have a ground clearance in a range of approximately one quarter inch to approximately one half inch. FIG. 2 is a perspective view of a chassis of a mobile radiation and ballistic shield with a ricochet plate, according to an illustrative embodiment. A ricochet plate 142 can be set at an angle, so that the bottom of the ricochet plate 142 is tilted away from the bottom of the shield system 110. The titled angle of the ricochet plate 142 can help to trap any rounds that may be fired under the shield system 110. The tilted angle of the ricochet plate 142 can also help to allow the mobile radiation and ballistic shield 100 to ride over door thresholds or other uneven parts of a floor without getting stuck and without requiring the user to lift the mobile radiation and ballistic shield 100 over the threshold.

Figure 3:
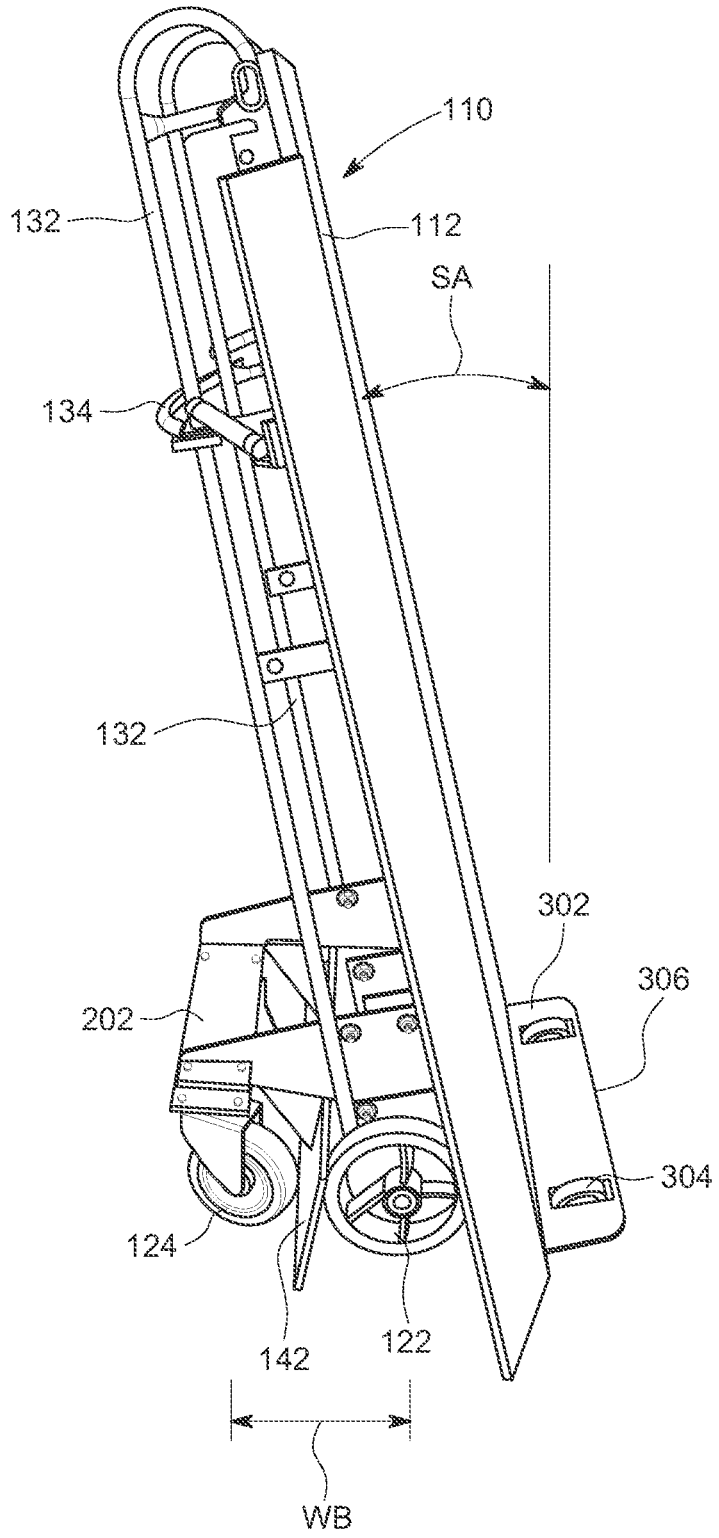
FIG. 3 is a side view of a mobile radiation and ballistic shield, according to an illustrative embodiment.

A mobile radiation and ballistic shield can have a foot plate 202. Foot plate 202 can provide a place for the user to put his foot at the rear of the mobile radiation and ballistic shield. A user can put a foot on the foot plate 202 to help to steer, guide, or push the mobile radiation and ballistic shield 100. In various embodiments, the foot plate can be a horizontal plate between the rear wheels. FIG. 3 is a side view of a mobile radiation and ballistic shield, according to an illustrative embodiment. A user can use the foot plate 202 in combination with one or more vertical bars 132 and/or horizontal bars 134 to manipulate and maneuver the mobile radiation and ballistic shield 100.

In a resting state, the central shield 112 can be at an angle SA of approximately 12° to approximately 15° from vertical. This angle allows the front of the central shield to extend over and cover the front wheels 122 at the front of the mobile radiation and ballistic shield, while also maintaining the center of gravity approximately over an area between the front wheels 122 and the rear wheels 124. With an angle from vertical SA of approximately 12° or more, the weight is far enough back so that the mobile radiation and ballistic shield is unlikely to tip forward if it encounters a bump or dip while traveling forward. With an angle from vertical SA of approximately 15° or less, the user can still rock or tilt the shield, or can transfer weight between front wheels and back wheels, if necessary to overcome obstacles, while maintaining the center of gravity of the central shield approximately over an area between the front wheels and the rear wheels. This tilt angle allows for a compact wheelbase for ease of mobility, while also allowing the user to manipulate the mobile radiation and ballistic shield without fear of the shield tipping forward or backward onto the user.

The mobile radiation and ballistic shield 100 can have a wheelbase length WB measured from the center of the front wheels 122 to the center of the rear wheels 124 that can be in a range of approximately 10 inches to approximately 16 inches. A wheel base of approximately 10 inches or more can provide a large enough base so that the center of gravity of the shield system 110 can be maintained over an area between the front wheels and the rear wheels, and substantially decreases the risk of the mobile radiation and ballistic shield tipping over while maneuvering through tight spaces or encountering obstacles while moving. A wheelbase of approximately 16 inches or less can avoid the risk of the user tripping over the chassis while walking behind the mobile radiation and ballistic shield 100. In an embodiment, the wheelbase length can be approximately 12 inches for sufficient stability, support for the center of gravity, and ease of use for a user walking behind the shield with minimal tripping risk.

A user can push downward and/or forward on the foot plate 202 while simultaneously pulling downward and/or pushing forward on one or more of the vertical bars 132 and/or horizontal bars 134 to help the mobile radiation and ballistic shield 100 to get past uneven surfaces, such as a gap at the entrance of an elevator. By pushing forward on the foot plate 202 while pulling backwards on the bars 132 and/or 134, the user can transfer more of the weight of the shield system 110 onto the rear wheels 124 and can reduce the load on the front wheels 122, so that the mobile radiation and ballistic shield 100 can be pushed over small bumps or gaps more easily. The mobile radiation and ballistic shield 100 can pivot backwards on the rear wheels 124 so that the front wheels can be entirely lifted off of the ground. A significant portion of the weight of the shield system 110 can be arranged above and in front of the front wheels 122. The forward positioning of the weight of the shield system 110 allows the mobile radiation and ballistic shield 100 to pivot backwards on the rear wheels 124 to lift the front wheels 122 up several inches off of the ground without any significant risk of the mobile radiation and ballistic shield 100 tipping backwards.

A front skid plate 302 can help a user to maneuver the mobile radiation and ballistic shield 100 over thresholds and bumps. The front skid plate can be set at an angle of approximately 15° relative to the ground, and can have a front clearance at the front lip 306 in a range of approximately two inches to approximately four inches, and can be approximately three inches. The protective shield system can have a lower ground clearance of approximately 1 inch to approximately 2.5 inches, and can be approximately 1.75 inches. The front skid plate 302 can extend at an angle out in front of the shield and upwards from the low ground clearance point to the front lip 306, so that the front skid plate can be used to help guide the shield over obstacles. Positioning the protective shield system 1 inch to 2.5 inches off of the ground can help to reduce the possibility of rounds passing under the protective shield system, and the angled front skid plate can help to ease the protective shield 110 over obstacles. The front clearance of the skid plate can allow the front of the mobile radiation and ballistic shield 100 to clear ordinary thresholds and bumps without the user needing to pivot the shield 100 backwards on the rear wheels. The skid plate 302 can have one or more roller wheels 304 that can help the shield 100 to roll over thresholds or other uneven surfaces. Once the front lip 306 of the skid plate 302 has cleared an obstacle such as a threshold, if necessary a user can transfer weight to the back wheels 124 and/or can use the roller wheels 304 to help ease the shield 100 over the obstacle. The front roller wheels 304 can also help to prevent the mobile radiation and ballistic shield from tipping forward when the mobile radiation and ballistic shield encounters an obstacle, because the roller wheels 304 can help the shield to move over and past the obstacle, instead of hitting the obstacle with forward momentum and having the bottom of the shield stop suddenly while the top of the shield continues forward with momentum. Front skid plate 302 can also act as a brake to prevent the mobile radiation and ballistic shield 100 from tipping forward. Because the front skid plate 302 extends rigidly out in front of the mobile radiation and ballistic shield 100, it can engage with the ground and make the front lip 306 become the pivot point when the mobile radiation and ballistic shield 100 is tipping forward.

Figure 4:
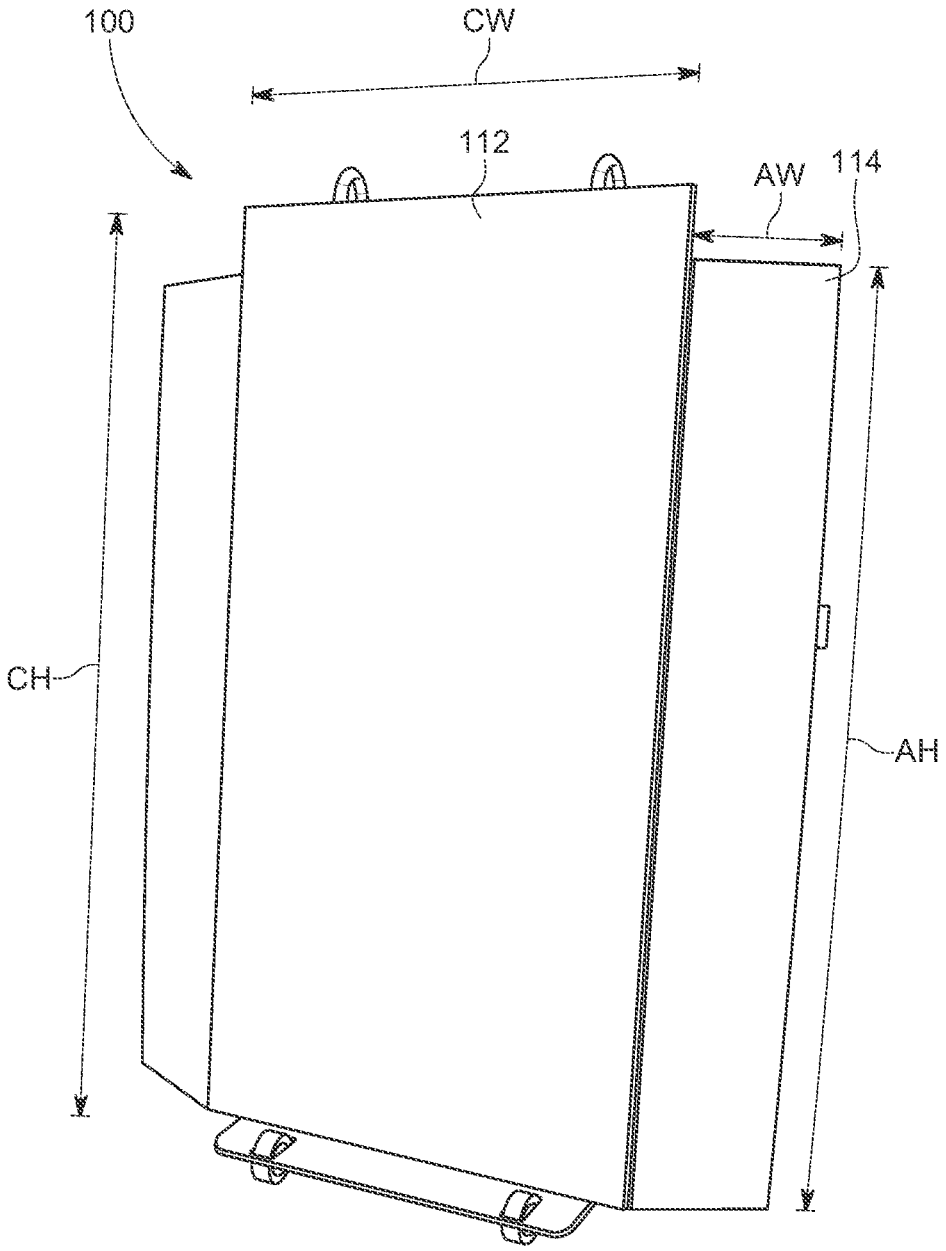
FIG. 4 is a front view of a mobile radiation and ballistic shield with dimensions, according an illustrative embodiment.

FIG. 4 is a front view of a mobile radiation and ballistic shield with dimensions, according an illustrative embodiment. A central shield 112 can have a central shield width CW that can be narrower than a doorway, so that the mobile radiation and ballistic shield 100 to pass through the doorway or onto an elevator without needing to be turned sideways or otherwise angling through the doorway, and the central shield width CW can be wide enough to allow more than one use to hide behind the central shield 112 side by side at the same time. The central shield width CW can be in a range between approximately 28 and approximately 32 inches. The central shield width CW can be in a range between approximately 31 and approximately 32 inches. The auxiliary shield 114 can have an auxiliary shield width AW in a range between approximately 6 and approximately 12 inches. The auxiliary shield width AW can be approximately 8 inches. The central shield can have a central shield height CH in a range between approximately 58 inches and approximately 60 inches. The auxiliary shields can have an auxiliary shield height of approximately 54 inches.

Figure 5:
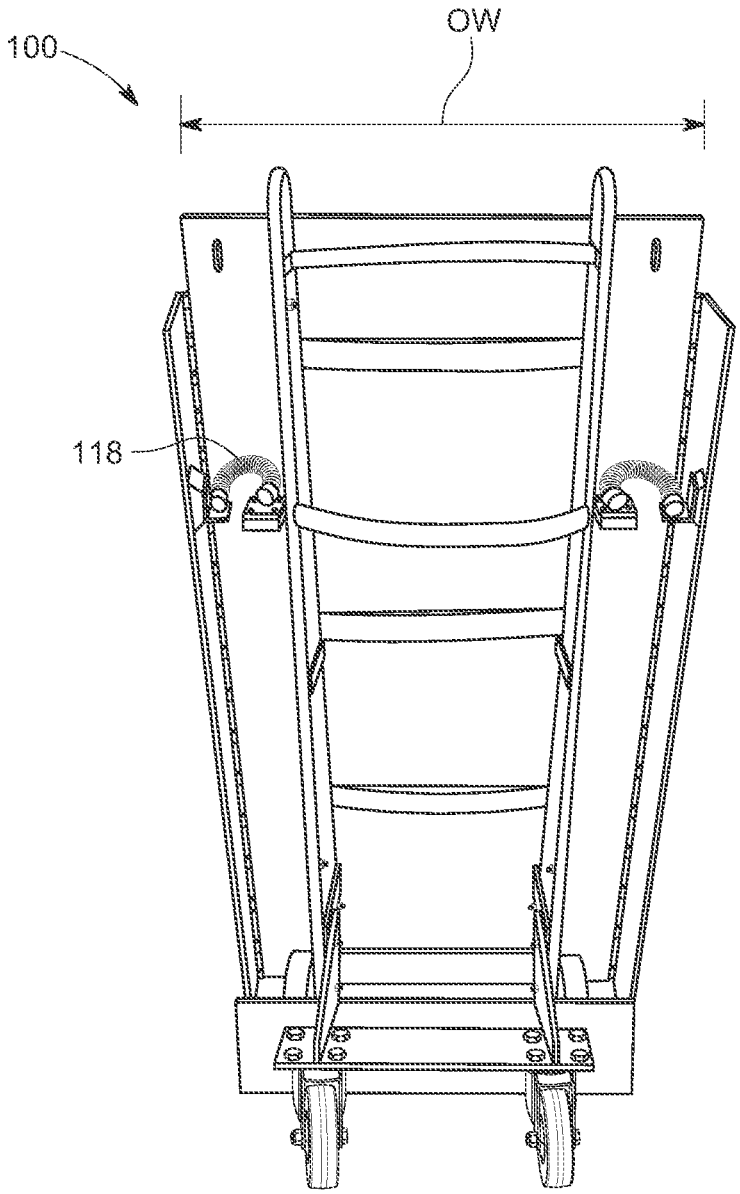
FIG. 5 is a rear view of a mobile radiation and ballistic shield in a first collapsed state; according to an illustrative embodiment.

FIG. 5 is a rear view of a mobile radiation and ballistic shield in a first collapsed state; according to an illustrative embodiment. In the first collapsed state, the mobile radiation and ballistic shield 100 can have an overall width OW of 32 inches or less. The braces 118 can be a flexible material that can allow the auxiliary shields to collapse inwards, while also biasing the auxiliary shields outwards into the deployed state.

The mobile radiation and ballistic shield can have front wheels 122 that can have a distance between the centers of the front wheels in a range between approximately 20 inches to approximately 28 inches. A distance between the front wheels of approximately 20 inches or more can provide stability for the shield system during maneuvering and encountering obstacles, and a distance between the front wheels of approximately 28 inches or less can prevent the auxiliary shields from interfering with the wheels when the auxiliary shields are in a collapsed state. In an embodiment, the front wheels 122 can be spaced approximately 22 inches apart. The rear wheels 124 can have a distance between the centers of the rear wheels in a range between approximately 12 inches to approximately 28 inches. A distance between the rear wheels that is less than a distance between the front wheels can increase the agility and maneuverability of the mobile radiation and ballistic shield 100. In an embodiment, the rear wheels 124 can be approximately four inches to approximately six inches closer together than the front wheels 122. In an embodiment, the rear wheels can have a distance between the center of the rear wheels in a range between approximately 16 inches and 18 inches so that the rear wheels provide sufficient stability and support for the center of gravity, while also providing excellent agility and maneuverability.

Figure 6:
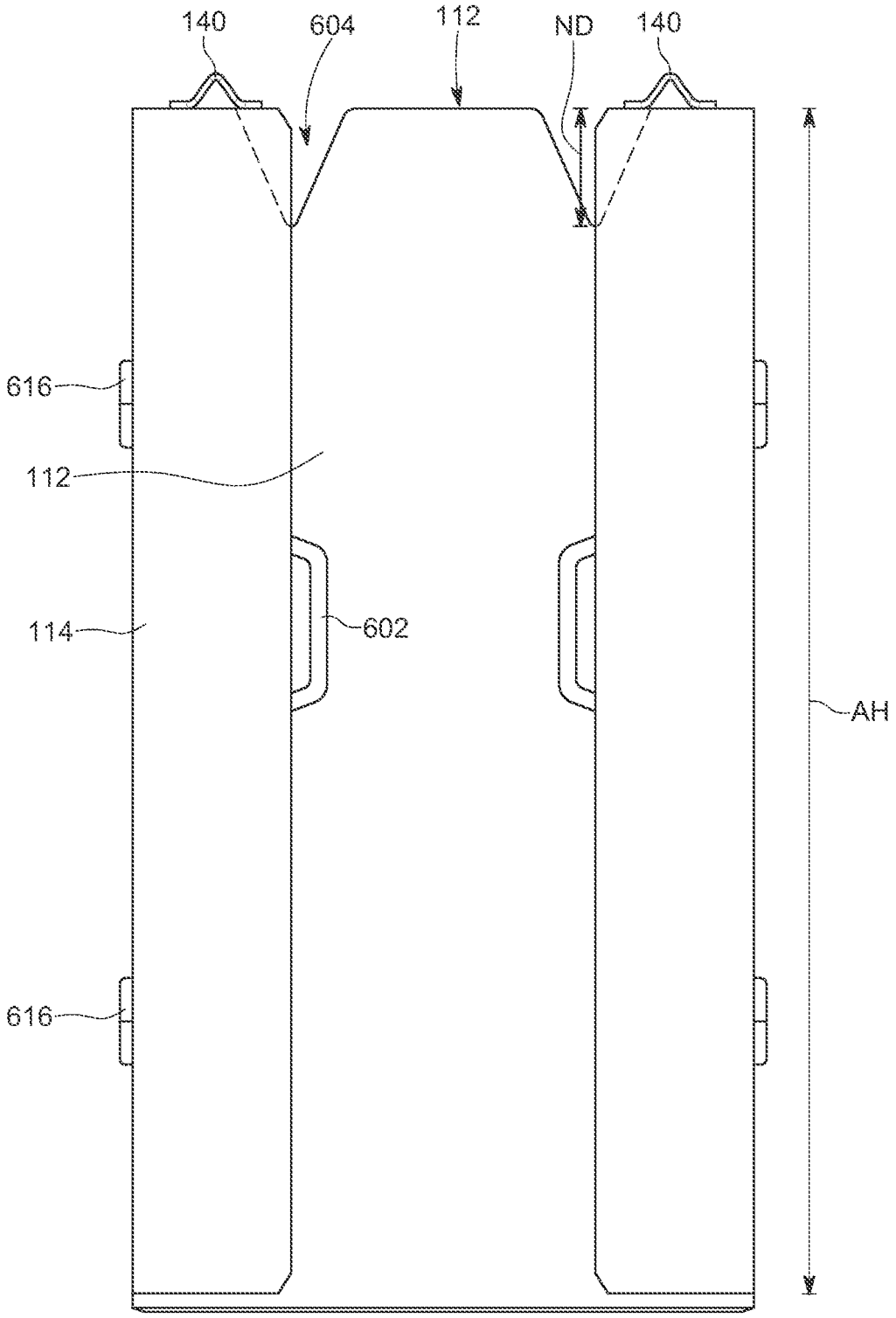
FIG. 6 is a partial front view of a mobile radiation and ballistic shield in a second collapsed state, according to an illustrative embodiment.

FIG. 6 is a partial front view of a mobile radiation and ballistic shield in a second collapsed state, according to an illustrative embodiment. In various embodiments, a mobile radiation and ballistic shield 100 can have lift-off pivot hinges 616 that can allow the auxiliary shields 114 to be lifted off and removed from the shield system. In various embodiments, the auxiliary shields 114 can also be hinged forward for convenient storage and transportation. The auxiliary shields 114 can rest on the central shield 112 in the second collapsed state. The auxiliary shields 114 can have handles 602 that can be used for removing, deploying and/or collapsing the auxiliary shields 114. The handles 602 can also be used by the user for steering and maneuvering the mobile radiation and ballistic shield in the first collapsed state and/or the deployed state. In various embodiments, the auxiliary shield height AH can be approximately the same as the central shield height CH. The auxiliary shield height can be approximately 60 inches. The central shield 112 can have one or more central notches 604 (shown partially in phantom behind the auxiliary shields) that can have a notch depth ND of approximately 6 inches. The central notches 604 can allow a user to peek out from behind the shield in a collapsed state while remaining partially protected behind the shield. Lift tabs 140 can extend above the shield system 110. The shield system 110 can have lift tabs on the central shield 112 and on the auxiliary shield 114 so that a hook can be passed through the lift tabs to assist in hoisting the shield system 110. In various embodiments, the lift tabs 140 can be aligned in the second collapsed state, and a hook can be passed through the two aligned lift tabs 140 to lift up on the central shield 112 and the auxiliary shield 114 simultaneously.

Figure 7:
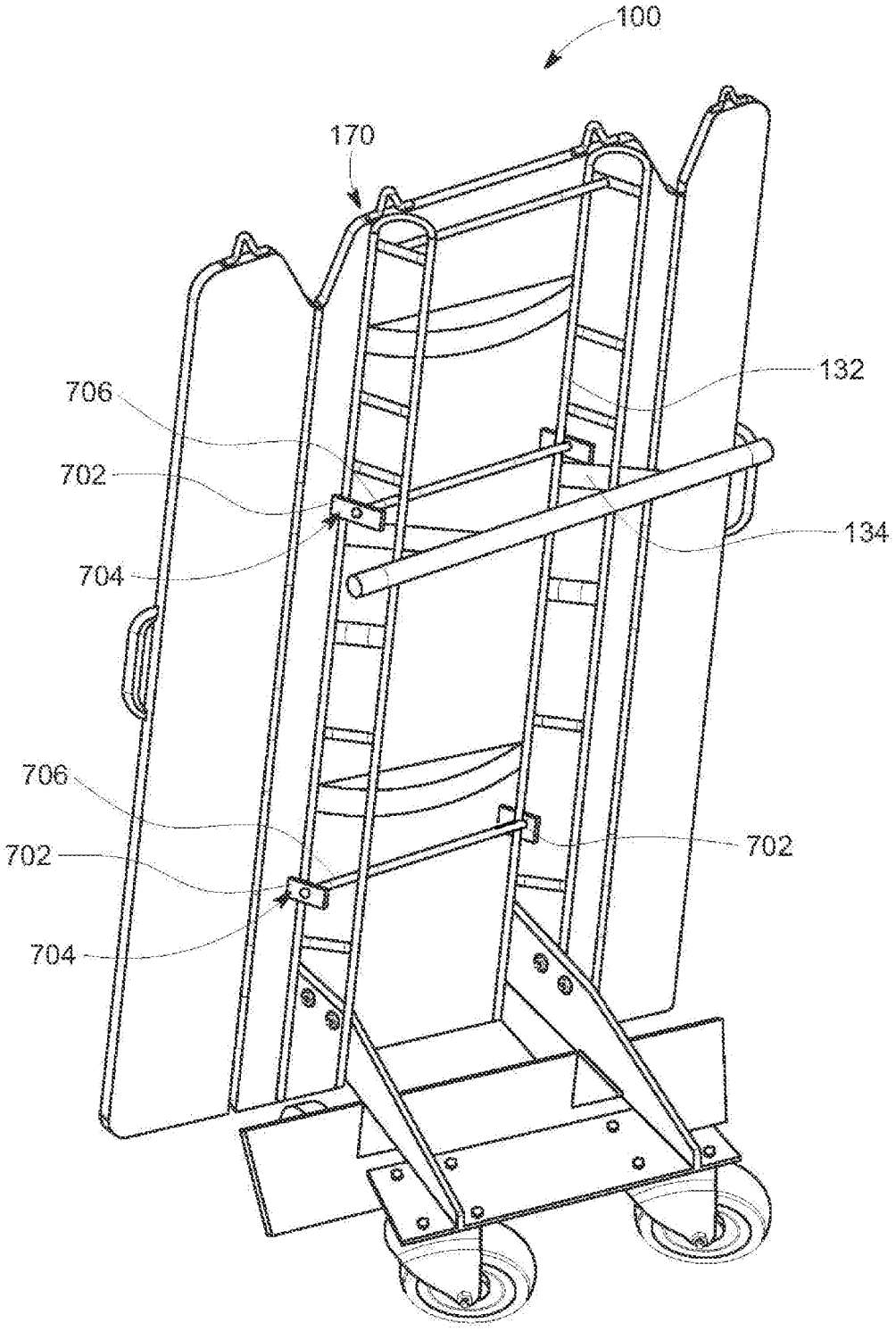
FIG. 7 is a rear perspective view of a mobile radiation and ballistic shield showing a modular arrangement of components, according to an illustrative embodiment.

FIG. 7 is a rear perspective view of a mobile radiation and ballistic shield showing a modular arrangement of components, according to an illustrative embodiment. A mobile radiation and ballistic shield 100 can have a removable protective shield system 110. In an embodiment, the protective shield system 110 can have tabs 702 with holes 704. The protective shield system 110 can be secured to the frame 130 with one or more stay rods 706 that can pass through the holes 704 in the tabs 702 to secure the protective shield system 110 to the frame 130. In an embodiment, the one or more stay rods 706 can be supported on the horizontal bars 134 of the support frame, and a vertical bar 132 of the support frame can be held between the protective shield system 110 and the one or more stay rods 706. The protective shield system 110 can be quickly and easily removed and replaced with a different protective shield system 110 depending on the protective needs.

Figure 8A:
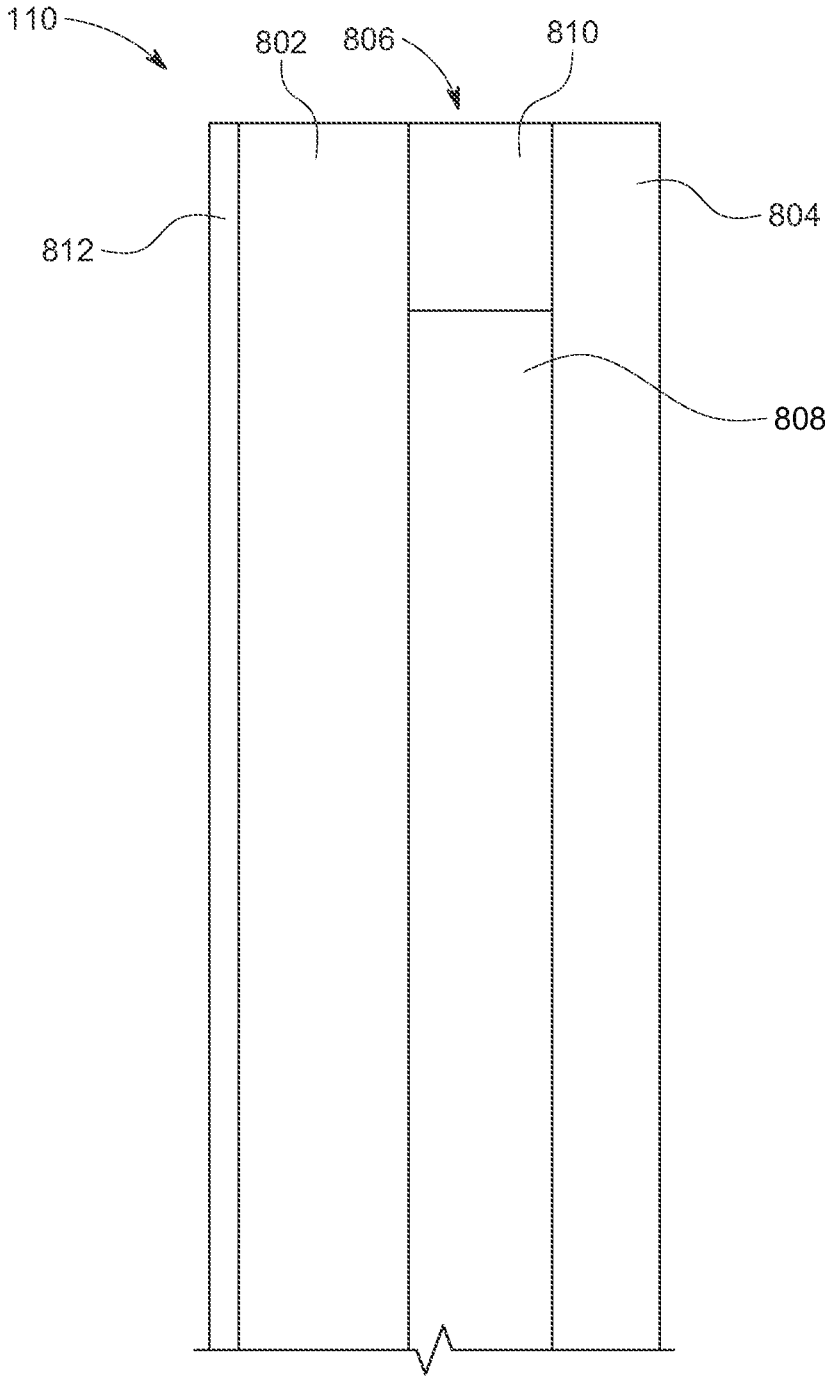
FIG. 8A is a cross sectional view of a protective shield system showing internal layers, according to an illustrative embodiment.
Figure 8B:
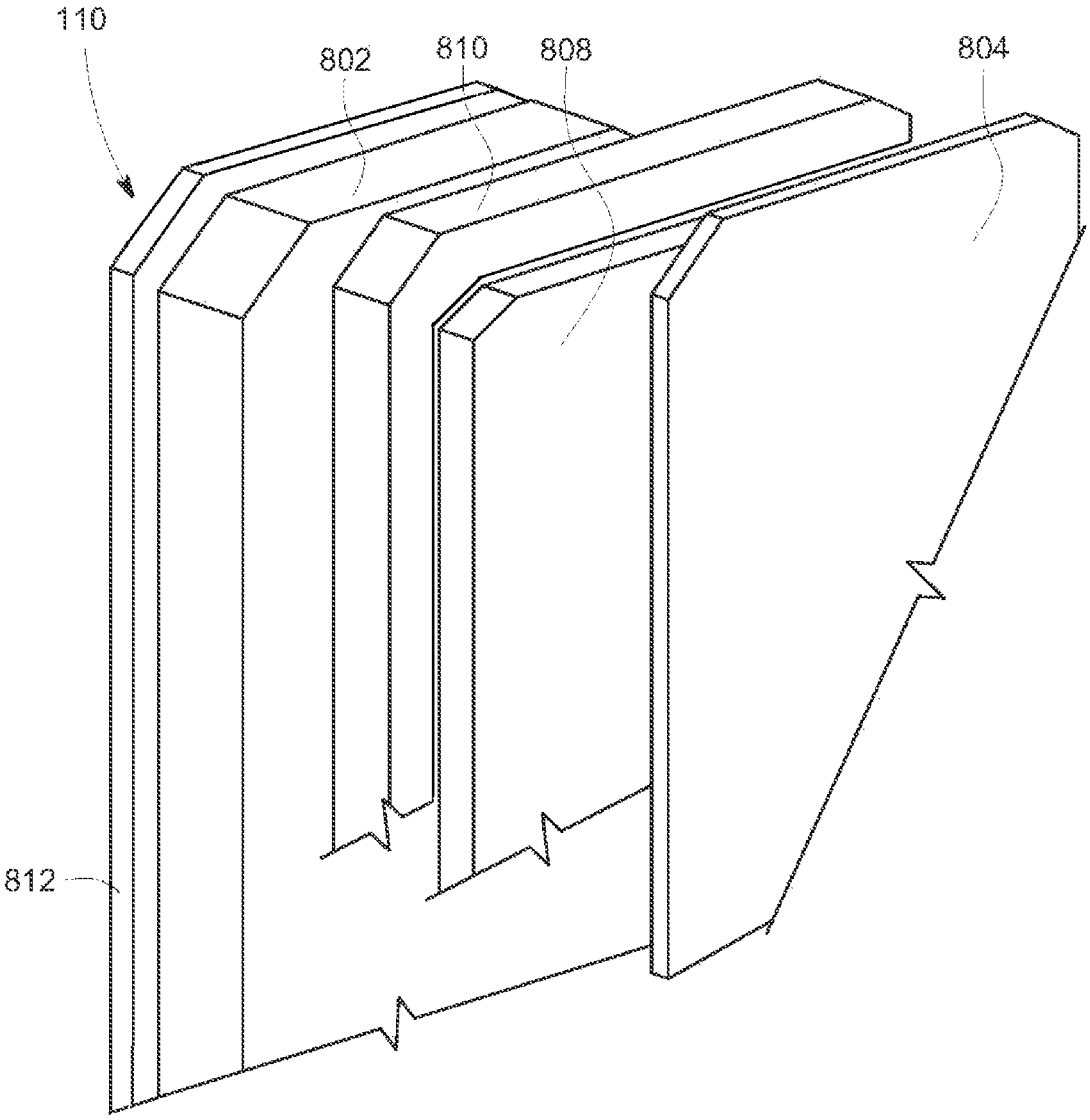
FIG. 8B is an exploded perspective view of the layers shown in FIG. 8A, according to an illustrative embodiment.

FIG. 8A is a cross sectional view of a protective shield system showing internal layers, according to an illustrative embodiment, and FIG. 8B is an exploded perspective view of the layers shown in FIG. 8A. In an embodiment, a protective shield system 110 can have an outer layer 802 that can be made from steel and can be approximately ⅜ of an inch thick. Outer layer 802 can be the outermost layer facing towards an oncoming threat. The outer layer 802 can be a carbon-manganese steel. Outer layer 802 can be a high-hardness, high strength quenched and tempered chrome-moly, boron treated alloy plate. Outer layer 802 can have a high resistance to impact abrasion. Outer layer 802 can be heat treated to exhibit through-hardening. Outer layer 802 can be a steel with a Brinell Hardness Number of 460-544. Outer layer 802 can be AR500 steel. Outer layer 802 can stop rounds from .308 and 30-06 caliber rifles, various calibers of assault rifles, 50 caliber handguns, 20 gauge shotgun slugs, and other common projectile-based weapons.

A protective shield layer can have an inner layer 804 that can be approximately 12 gauge steel. Inner layer 804 can face inwards towards the user. A protective shield system 110 can have middle layer 806. Middle layer 806 can include a radiation screen 808, and middle layer 806 can include a steel filler, or frame 810. Radiation screen 808 can be made from lead and can be approximately ¼ inch thick. Radiation screen 808 can protect a user from any direct radiation from an uncontained high level radiation source. Radiation screen 808 can provide two half values of radiation attenuation and can reduce the exposure from 60-75% for 400-700 keV gamma photons, such as Cesium 137 and Iridium 192, at a distance of six feet. Radiation screen 808 can block 60-75% of radiation originating from in front of the shield.

In various embodiments, radiation screen 808 does not extend to the edges of the shield, and the steel filler 810 can surround and frame the radiation screen 808 on one or more sides. The edges of the protective shield system 110 can be layers of steel that can be welded and sealed together, and the combined steel edges of the protective shield can have sufficient strength to support the weight of the auxiliary shields on hinges at the side edges of the central shield, and can support the weight of the protective shield system 110 at lift tabs at the upper edges of the protective shield system 110. The steel filler 810 at the edge of the shield can increase the structural strength of the multi-layer protective shield system 110.

The outer layer 802 can be bonded to the steel filler 810, and the inner layer 804 can be bonded to the steel filler 810, so that the radiation screen 808 can be encapsulated by the outer layer and inner layer, and the filler around the edges. In various embodiments, the filler can surround the radiation screen around all four edges, and the radiation screen can be entirely encapsulated. In various embodiments, the filler can surround two or three edges of the radiation screen, so that the radiation screen is partially encapsulated by the outer layer, the inner layer, and the filler around the edges.

In various embodiments, the auxiliary shields can have an outer layer 802 and a middle layer 806 with a radiation screen 808. In various embodiments, the auxiliary shields can be free of a middle layer 806 and radiation screen 808. The auxiliary shields can be a ballistic shield that can be made of the same or similar material as outer layer 802. In various embodiments, ballistic cloth 812 can be draped over at least a portion of the mobile radiation and ballistic shield to prevent ricochets from bouncing off of the protective shield system.

Figure 9:
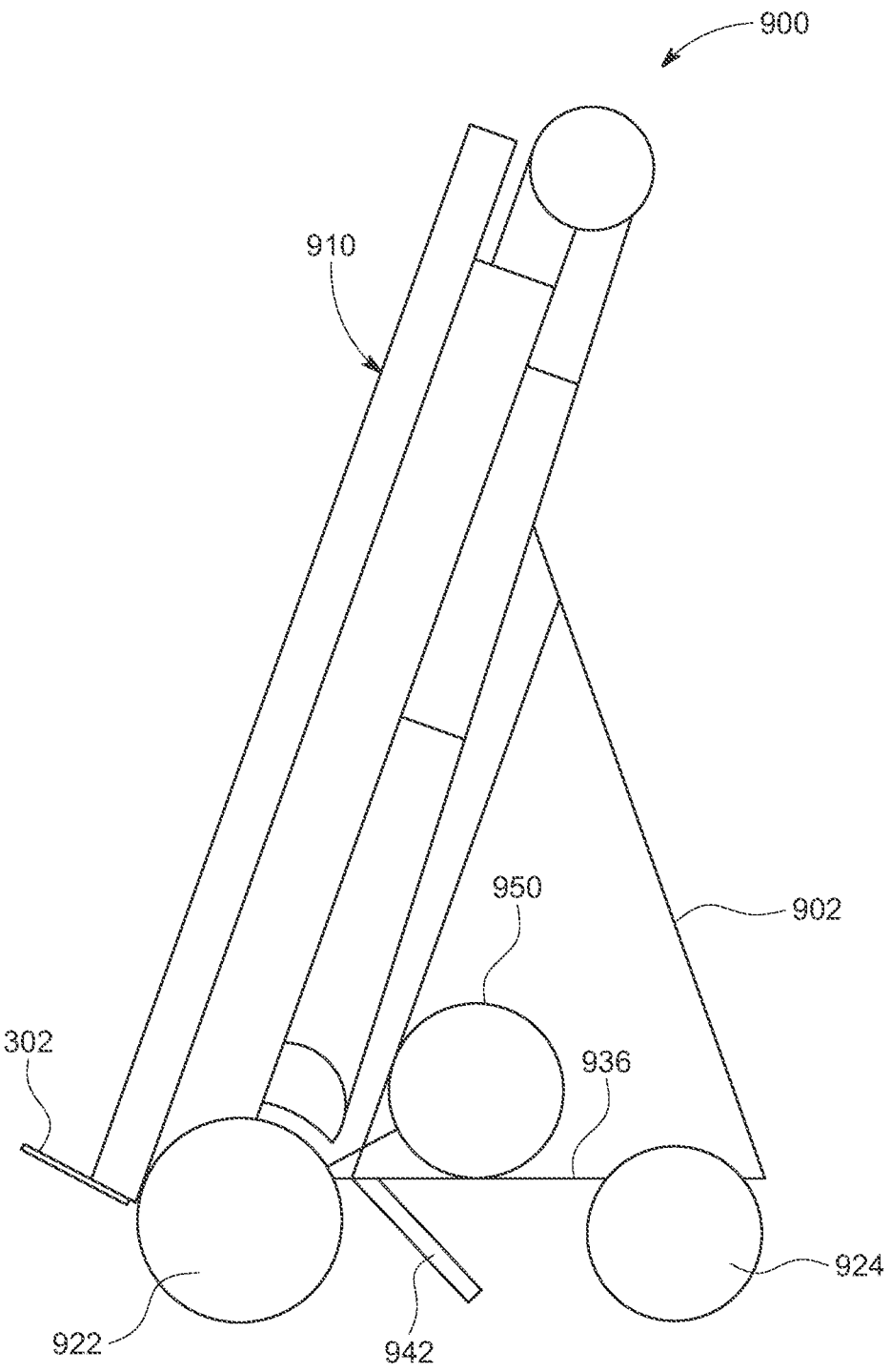
FIG. 9 is a diagrammatic side view of an all-terrain mobile radiation and ballistic shield, according to an illustrative embodiment.

FIG. 9 is a diagrammatic side view of an all-terrain mobile radiation and ballistic shield, according to an illustrative embodiment. In various outdoor and all-terrain embodiments, an all-terrain mobile radiation and ballistic shield 900 can be adapted for more rugged terrain by moving the rear wheels 924 back to increase the wheelbase between the front wheels 922 and the rear wheels 924. The angle from vertical SA can be increased up to approximately 18° and the wheelbase can be lengthened correspondingly to maintain the center of gravity approximately over an area between the front wheels and the rear wheels. The wheelbase can be lengthened up to a wheelbase of approximately 16 inches. Increasing the wheelbase to approximately 16 inches can increase stability over uneven terrain while keeping the rear wheels close enough to the shield system to avoid having a user trip over the rear wheels or the back of the chassis. The greater angle from vertical SA and the longer wheelbase allows for increased stability over difficult terrain. In various outdoor and all-terrain embodiments, more of the weight of the protective shield system 910 can be supported by the rear wheels 924. By moving the weight of the protective shield system 910 backward slightly from the front wheels, the mobile radiation and ballistic shield 910 can be more easily pushed or maneuvered over uneven terrain, and can be more stable and less likely to tip forward during maneuvering. One or more side buttresses 902 can be used to support the weight of the protective shield system 910 and can transfer weight to the chassis 936 and/or rear wheels 924.

The all-terrain mobile radiation and ballistic shield 900 can be adapted for uneven terrain by increasing the size of the rear wheels 924 and/or increasing the size of the front wheels 922. Increasing the size of the wheels can include increasing the radius and/or width of the wheels to adapt to the environment where the all-terrain mobile radiation and ballistic shield 900 will be used. The front wheels 922 can be larger than the rear wheels 924. Increasing the size of the front wheels can help the mobile radiation and ballistic shield 100 to travel over uneven ground, and keeping the size of the rear wheels smaller than the front wheels can keep the center of gravity lower and can increase stability for the all-terrain mobile radiation and ballistic shield. Having rear wheels that are smaller than the front wheels can improve stability of the all-terrain mobile radiation and ballistic shield when traveling uphill or over uneven ground.

The all-terrain mobile radiation and ballistic shield 900 can be adapted for uneven terrain by increasing the distance between the rear wheels 924 up to approximately 28 inches and/or increasing the distance between the front wheels 922 up to approximately 28 inches. Increasing the distance between the wheels can increase the lateral stability of the all-terrain mobile radiation and ballistic shield 900, and prevent the shield from tipping sideways when traversing a hill or other uneven ground.

The front skid plate 302 and the protective shield system 910 can be raised up to increase the ground clearance between the ground and the front skid plate and/or protective shield system 910. In an embodiment, the ground clearance of the all-terrain mobile radiation and ballistic shield 900 can be approximately 5 to 6 inches. A hinged ricochet plate 942 can move and adapt as it is dragged over uneven terrain. The all-terrain mobile radiation and ballistic shield 900 can also include one or more on-board motors 950. The one or more on-board motors 950 can be operatively connected to the front and/or rear wheels so that the all-terrain mobile radiation and ballistic shield 900 can be self-propelled over uneven terrain. The one or more on-board motors 950 can also lower the center of gravity of the all-terrain mobile radiation and ballistic shield 900 which increases stability while traveling over uneven terrain.

Figure 10:
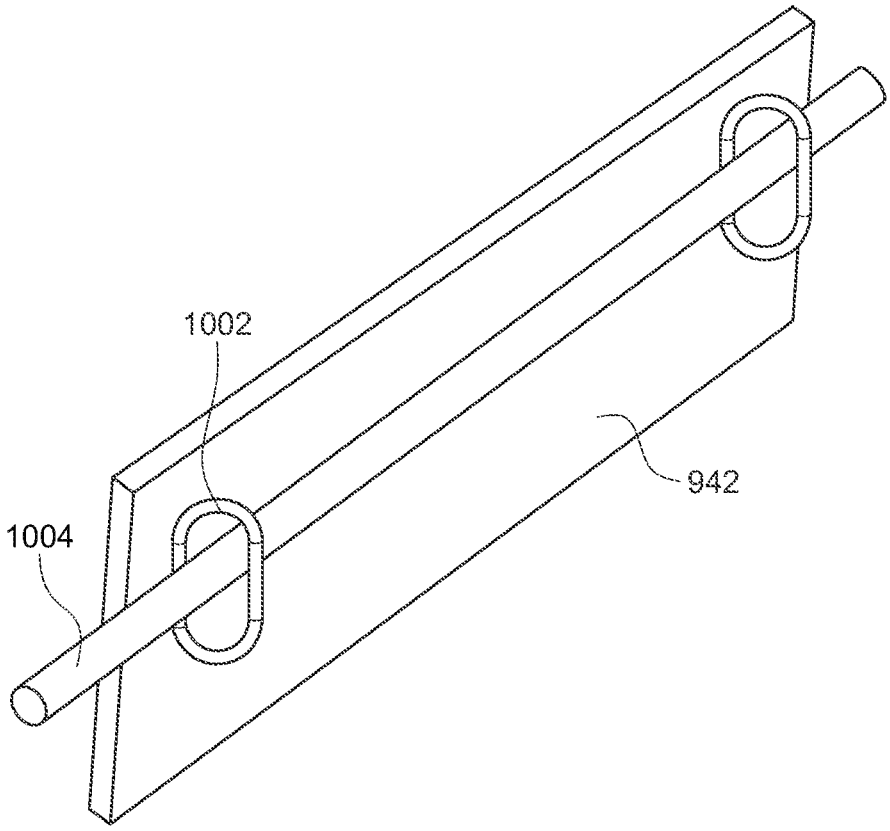
FIG. 10 is a perspective view of a hinged ricochet plate for an all-terrain mobile radiation and ballistic shield, according to an illustrative embodiment.

FIG. 10 is a perspective view of a hinged ricochet plate for an all-terrain mobile radiation and ballistic shield, according to an illustrative embodiment. In various embodiments, a hinged ricochet plate 942 can have rings 1002 that can allow the ricochet plate 942 to swing back and forth on the rings 1002. The hinged ricochet plate 942 can be suspended from a ring supporter 1004 that can be a horizontal support bar. Rings 1002 can have a larger inner diameter than the ring supporter so that the hinged ricochet plate 942 can move freely. The rings can have an elongated shape, so that the ricochet plate can move up and down over uneven terrain while remaining in a protective location.

Figure 11A:
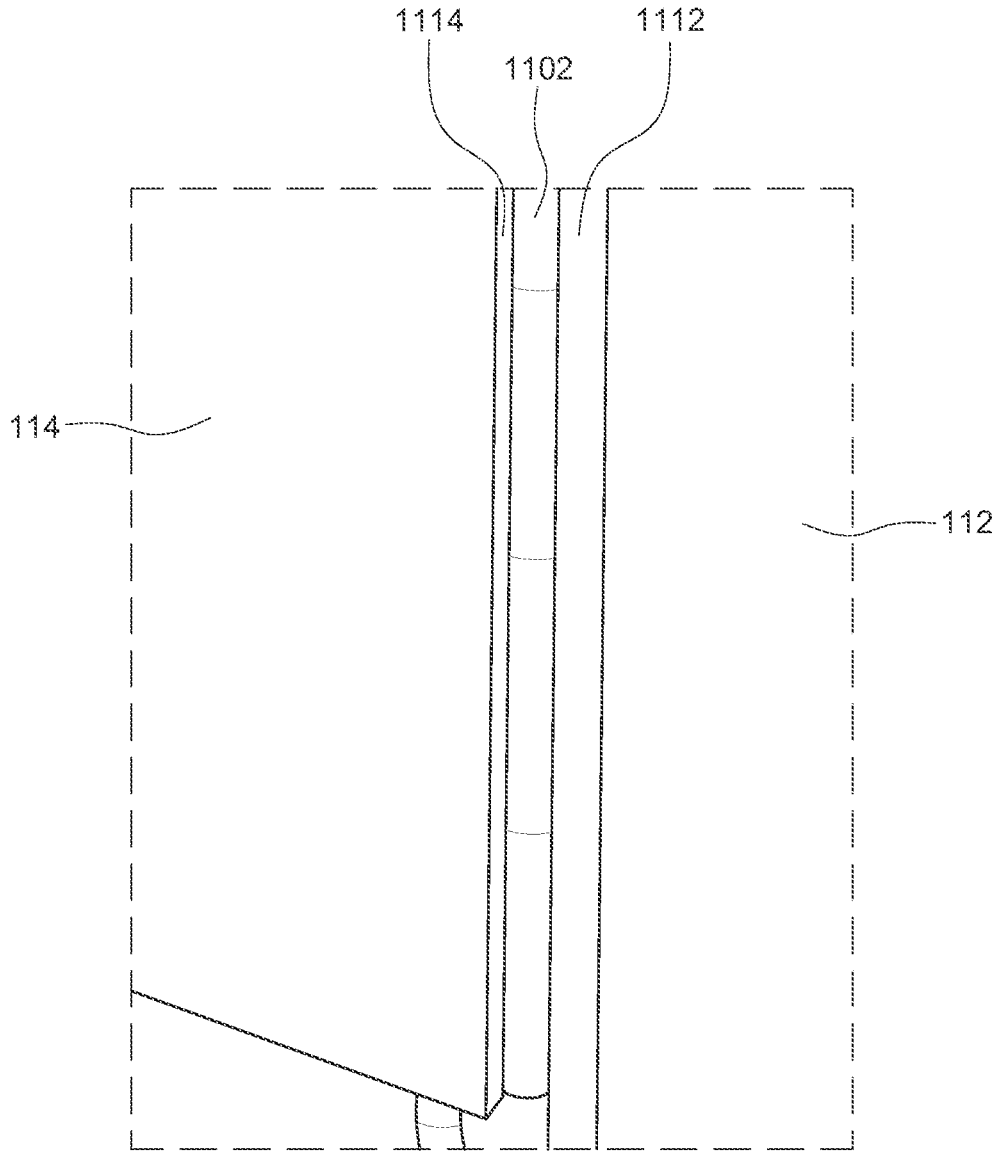
FIG. 11A is a front view of a hinge set behind the central shield and auxiliary shield, shown in a collapsed position according to an illustrative embodiment.
Figure 11B:
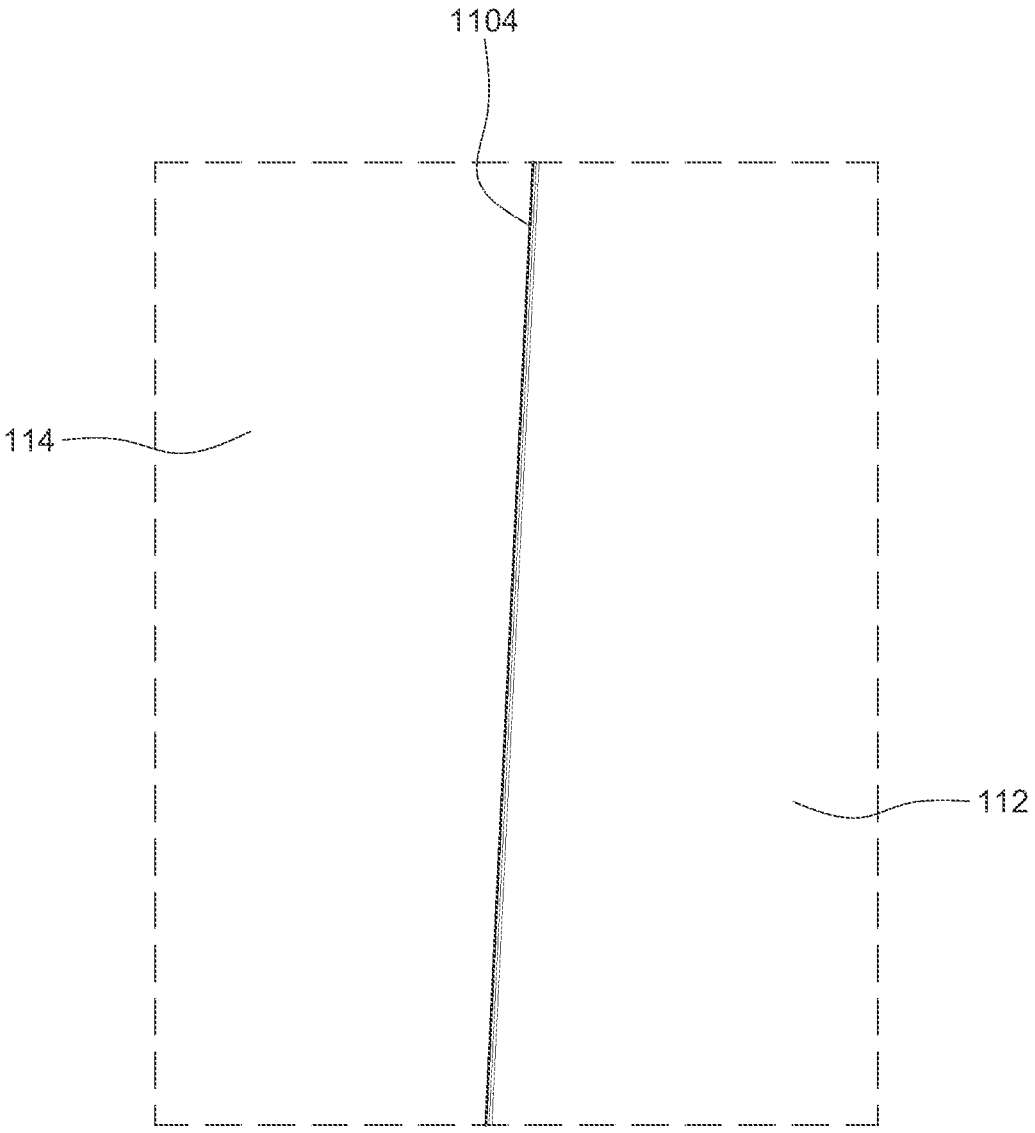
FIG. 11B is a front view of a seam between the central shield and auxiliary shield shown in a deployed position with the hinge protected behind the shield, according to an illustrative embodiment.

FIG. 11A is a front view of a hinge set behind the central shield and auxiliary shield, shown in a collapsed position, and FIG. 11B is a front view of a seam between the central shield and auxiliary shield, shown in a deployed position with the hinge protected behind the shield, according to an illustrative embodiment. The hinge 1102 can be a piano hinge, or continuous hinge between the central shield 112 and auxiliary shield 114. In various embodiments, the hinge 1102 between the central shield 112 and the auxiliary shield 114 can be positioned entirely behind the shield system so that the hinge is protected by the shield system. In a collapsed position, the hinge 1102 can be seen from the front of shield, however, in when the auxiliary shield 114 is in a deployed position, the central shield 112 and auxiliary shield 114 meet together at a seam 1104, and the hinge 1102 is behind the seam and protected by the shield. The edges of the shields 1112, 1114 can be seen in the collapsed position, and the edges of the shields 1112, 1114 abut each other to form the seam 1104 in the deployed position.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, in various embodiments, the steel plate of the shield can be replaced by, or supplemented with, a titanium plate to decrease the weight of the shield while maintaining ballistic protection. Additionally, as used herein various directional and dispositional terms such as "vertical", "horizontal", "up", "down", "bottom", "top", "side", "front", "rear", "left", "right", and the like, are used only as relative conventions and not as absolute directions/dispositions with respect to a fixed coordinate space, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances (e.g. 1-2%) of the system. Accordingly, this description is meant to be taken only by way of example, and not to otherwise limit the scope of this invention.

What is claimed is:

1. A method of staying safe from simultaneous ballistic and radiation threats comprising:

deploying a plurality of auxiliary shields panels into an extended state relative to a central shield;

walking behind a mobile shield;

blocking incoming ballistic fired shots with the mobile shield; and blocking between 60-75% of incoming gamma radiation that originates from in front of the mobile shield by using the mobile shield to block the radiation, wherein the ballistic fired shots and the radiation are blocked at the same time.

2. The method of claim 1, wherein the auxiliary shields are hingedly attached to the mobile shield.

3. The method of claim 2, wherein the auxiliary shield panels are held in the extended state via one or more braces.

4. The method of claim 3, wherein the one or more braces comprise one or more semi-rigid coil springs.

5. The method of claim 4, further comprising stowing the auxiliary shields into a collapsed state by pushing or pulling at least one of the one or more semi-rigid coil springs.

6. The method of claim 1, wherein walking behind the mobile shield comprises moving the mobile shield via front wheels and rear wheels, wherein the front wheels are larger than the rear wheels.

7. The method of claim 1, further comprising putting a foot on a foot plate while walking behind the mobile shield.

8. The method of claim 1, wherein the central shield comprises an outer layer of steel with a Brinell Hardness Number of 460-544.

9. The method of claim 1, wherein the central shield comprises a middle layer comprising a radiation screen.

10. The method of claim 9, wherein the radiation screen is configured to block the between 60-75% of incoming gamma radiation.

11. The method of claim 10, wherein the radiation screen is configured to provide two half values of radiation attenuation and reduce exposure from 60-75% for 400-700 keV gamma photons of at least one of Cesium 137 or Iridium 192.

* * * * *